US006062900A

United States Patent [19]

Juntwait

[11] Patent Number: 6,062,900

[45] Date of Patent: May 16, 2000

[54] ZIF FFC CONNECTOR HAVING A STRAIN RELIEF

[75] Inventor: Eric Juntwait, Irvin, Calif.

[73] Assignee: Hon Hai Precision Ind. Co., Ltd., Taipei Hsien, Taiwan

[21] Appl. No.: 09/201,329

[22] Filed: Nov. 30, 1998

[51] Int. Cl.[7] ..... H01R 9/07

[52] U.S. Cl. ..... 439/495

[58] Field of Search ..... 439/496, 495, 439/67, 35

[56] References Cited

U.S. PATENT DOCUMENTS

| | | | |
|---|---|---|---|
| 3,149,896 | 9/1964 | Hall | 439/329 |
| 3,997,233 | 12/1976 | Evans | 439/495 |
| 4,188,086 | 2/1980 | Inouye et al. | 439/495 |
| 5,173,058 | 12/1992 | Broeksteeg et al. | 439/267 |
| 5,389,741 | 2/1995 | Ueno | 439/422 |
| 5,690,510 | 11/1997 | Chrishima | 439/496 |

*Primary Examiner*—Khiem Nguyen
*Assistant Examiner*—J. F. Duverne
*Attorney, Agent, or Firm*—Wei Te Chung

[57] ABSTRACT

An FFC connector having a strain relief comprises an elongate dielectric housing (10) having front and rear faces (10*a*, 10*b*). The front face (10*a*) defines a lengthwise slot (10*c*) for receiving a flat flexible cable (20) therein. The housing (10) defines a plurality of passageways (11) communicating with the slot (10*c*). Each passageway (11) receives a terminal (12) therein for electrically connecting with a conductor of the inserted flat flexible cable (20). A supporting platform (30) is assembled to the dielectric housing (10). An elongate latch (31) upwardly extends from a front periphery of the platform (30) thereby defining a receiving space therein. An edge of a backing plate (22) of the inserted flat flexible cable (20) interlocks with the supporting platform (30).

7 Claims, 4 Drawing Sheets

ZIF FFC CONNECTOR HAVING A STRAIN RELIEF

FIELD OF THE INVENTION

The present invention relates to a connector, and more particularly to a zero-insertion-force flat flexible cable connector having a strain relief.

DESCRIPTION OF PRIOR ART

Flat Flexible Cables or FFCs are used in many electronic applications to reduce overall size and provide a flexible interconnection between two printed circuit boards. An FFC can be connected directly to a PCB by soldering or by using an FFC connector. One common problem occurring when using FFC connectors is the inadequate strain relief existing between the cable and the connector. Any type of motion or vibration can cause either fretting corrosion at the connector/cable interface or, in some cases, the FFC may completely disengage from the connector.

Connection between a typical FFC connector and an FFC is accomplished by inserting the FFC into a receiving slot defined within a housing of the FFC connector whereby terminals of the connector project therein. In order to reduce a resisting force resulting from deflection of the terminals from their original positions during insertion of the FFC, a ZIF FFC connector is introduced. U.S. Pat. No. 4,477,137 issued to Ayer on October 1984, U.S. Pat. No. 4,640,562 issued to Shoemaker on February 1987, U.S. Pat. No. 4,863,395 issued to Babuka et al. on September 1989, U.S. Pat. No. 5,213,534 issued to Garnder et al. on May 1993, U.S. Pat. No. 5,240,430 issued to Soes on August 1993, and U.S. Pat. No. 5,542,855 issued to Asai on August 1996 describe pertinent structures.

SUMMARY OF THE INVENTION

An objective of this invention is to provide an FFC connector having a protrusion integrally formed on a housing thereof thereby interlocking a backing tape of an inserted flat flexible cable.

In order to achieve the objective set forth, an FFC connector having a strain relief comprises an elongate dielectric housing having front and rear faces. The front face defines a lengthwise slot for receiving a flat flexible cable therein. The housing defines a plurality of passageways communicating with the slot. Each passageway receives a terminal therein for electrically connecting with a conductor of an inserted flat flexible cable. A supporting platform is assembled to the dielectric housing. An elongate latch upwardly extends from a front periphery of the platform thereby defining a receiving space therein. An edge of a back plate of the inserted flat flexible cable interlocks by the supporting platform. A cover is assembled to the supporting platform for securely pressing against a top face of the FFC thereby ensuring engagement between the backing tape and the elongate latch.

These and additional objectives, features, and advantages of the present invention will become apparent after reading the following detailed description of the preferred embodiment of the invention taken in conjunction with the appended drawings.

DESCRIPTION OF PREFERRED EMBODIMENT

Figure 1:
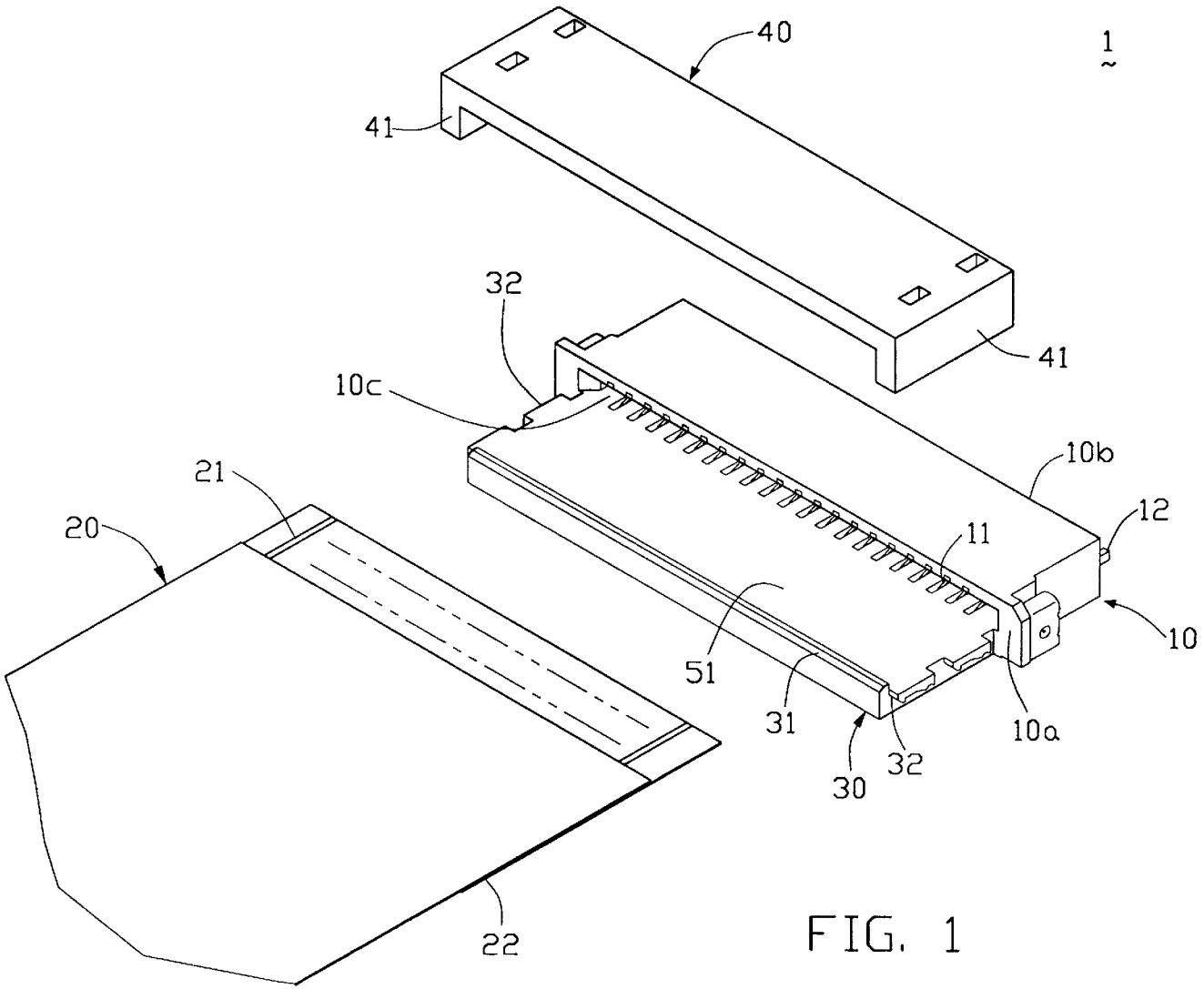
FIG. 1 is a perspective view of an FFC connector in accordance with the present invention.
Figure 2:
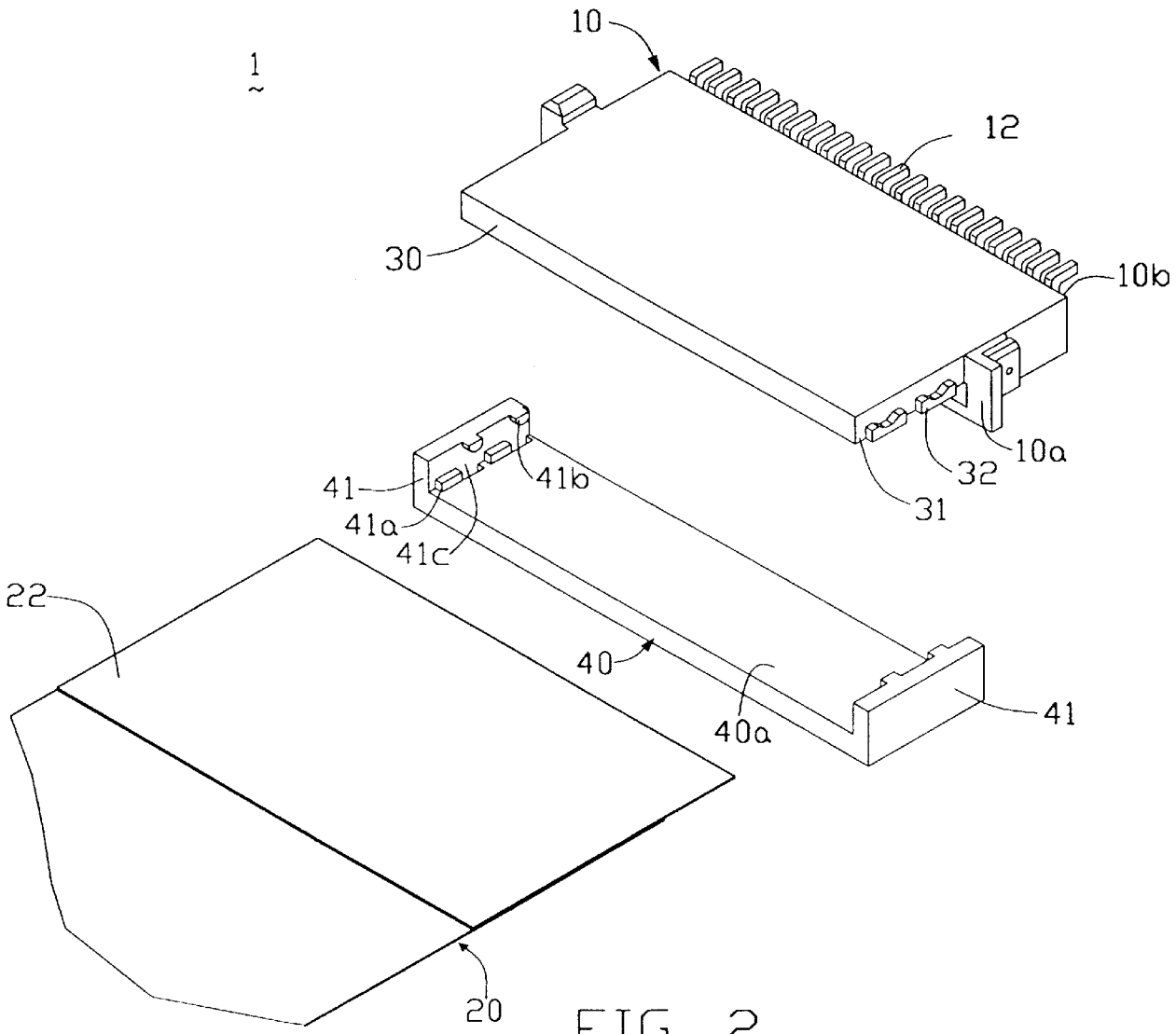
FIG. 2 is similar to FIG. 1 taken along a reverse angle.

Referring to FIGS. 1 to 5, an FFC connector 1 in accordance with the present invention comprises an elongate dielectric housing 10 having front and rear faces 10*a*, 10*b*. A lengthwise slot 10*c* is defined along the front face 10*a* for receiving a flat flexible cable 20 therein. The housing 10 defines a plurality of passageways 11 in communication with the slot 10*c*. Each passageway 11 securely receives a terminal 12 therein. A supporting platform 30 is assembled to the dielectric housing 10. An elongate latch 31 upwardly extends from a front edge of the platform 30. Two pairs of spaced wing tabs 32 laterally extend from opposite ends of the platform 30. Each wing tab 32 forms a cam surface 33 on a bottom thereof.

The cam surface 33 defines a first inclined face 33*a* serving as a guide. A stopper 33*b* is formed adjacent to the inclined face 33*a*. The cam surface 33 further forms a second inclined face 33*c* and a positioning recess 33*d* adjacent to the second inclined face 33*c*.

Figure 3A:
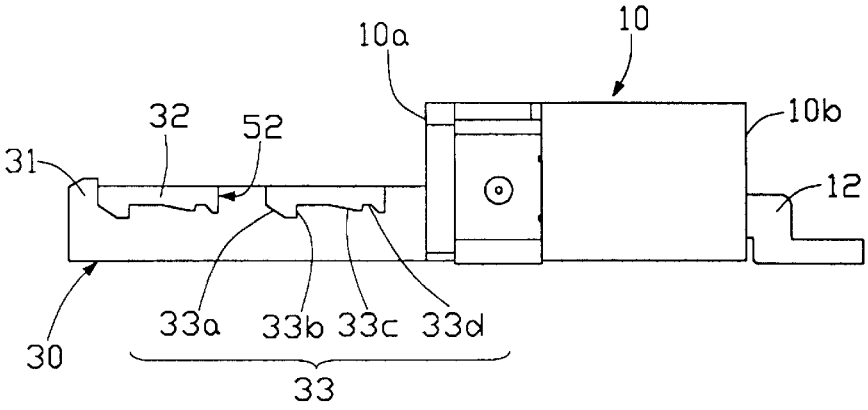
FIG. 3A is a side elevational view of a housing of the FFC connector.
Figure 3B:
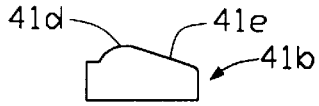
FIG. 3B is an enlarged front view of a cam of a cover used with the FFC connector.
Figure 4:
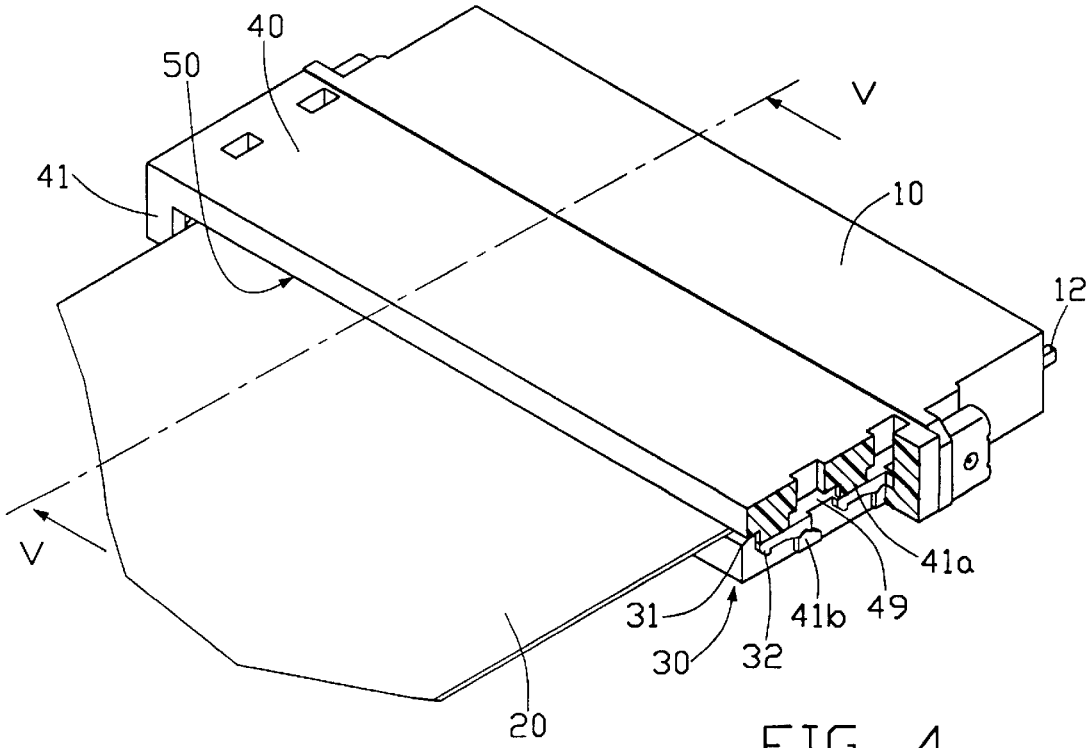
FIG. 4 is an assembled view of FIG. 1 with a portion cut away therefrom.

A cover 40 is assembled to the housing 10. The cover 40 forms a pair of clips 41 on lateral ends thereof. Each clip 41 forms a pair of biasing wedges 41*a* at a junction formed between the clip 41 and a bottom face 40*a* of the cover 40. A pair of cams 41*b* are formed at a lower edge of the clip 41. A slot 41*c* is defined between the cams 41*b* and the biasing wedges 41*a* for receiving the wing tabs 32. When the cover 40 is assembled to the housing 10, a slit 49 (FIGS. 4 and 5) is defined between the bottom face 40*a* (FIG. 2) of the cover 40 and a top face 51 (FIG. 1) of the platform 30 while a relatively smaller opening 50 is defined between the bottom face 40*a* of the cover 40 and the elongated latch 31 of the platform 30. Referring to FIG. 3B, the cam 41*b* forms an inclined face 41*e* and a hump 41*d*.

An FFC 20 having a plurality of conductors 21 is inserted into the lengthwise slot 10*c* of the housing 10 whereby the connectors 21 electrically connect with the terminals 12. The FFC 20 includes a back plate 22 attached to a bottom thereof thereby increasing rigidity of the FFC 20. A rear edge of the back plate 22 abuts against a wall of the elongate latch 31 when the cover 40 is securely assembled to the housing 10. By this arrangement, rearward movement of the inserted FFC 20 can be effectively reduced thereby eliminating disconnection of the conductors 21 from the terminals 12.

Figure 5:
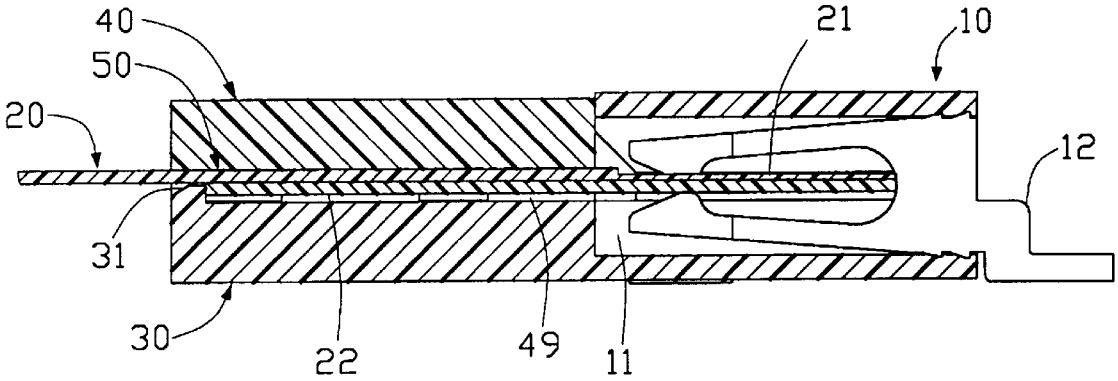
FIG. 5 is a cross sectional view taken along line V—V of FIG. 4.

In assembling, the cover 40 is first downward attached to the platform 30 wherein the front one of the cams 41*b* of the clip 41 is inserted through a gap 52 (FIG. 3A) defined between the two wing tabs 32 and whereby the wing tabs 32 are received in the slot 41*c*. The cover 40 is then moved toward the front face 10*a* of the housing 10. During movement of the cover 40, the inclined face 41*e* of the cam 41*b* slides along the first inclined face 33*a* of the corresponding cam surface 33 while the biasing wedge 41 a presses against a top face of the corresponding wing tab 32. The hump 41*d* then slides over the stopper 33*b* thereby limiting movement of the cover 40 in the opposite direction. As the cam 41*b* continues moving, the hump 41*d* slides along the second inclined face 33*c* until the hump 41 is securely seated in the recess 33*d*. By this arrangement, the cover 40 secures the FFC 20 to the housing 10 of the FFC connector 1 and any upward movement thereof is prevented. Under this situation, as shown in FIG. 5, the front portion of the FFC 20 with the back plate 22 is received within the slit 49 between the cover 40 and the platform 30 and further extends into the slot 10*c* for engagement with terminals 12 while only the conductors 21 of the FFC 20 extend backward through the opening 50 outward wherein as mentioned before, the rear edge of the back plate 22 abuts against the latch 31 for preventing withdrawal of the FFC 20 from the housing 10 of the connector 1.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

I claim:

1. An FFC connector having a strain relief, comprising:

an elongate dielectric housing having front and rear faces, said front face defining a lengthwise slot for receiving a flat flexible cable therein, said housing defining a plurality of passageways in communication with said slot, each passageway receiving a terminal therein for electrically connecting with said inserted flat flexible cable;

a supporting platform assembled to said dielectric housing, an elongate latch upwardly extending from a front periphery of said platform;

a cover cooperating with said supporting platform to define a slit for receiving said inserted flat flexible cable therebetween; and interlocking means arranged between said supporting platform and said cover for attaching said cover to said supporting platform, wherein said cover can be arranged in a first position in which an opening is defined for insertion of said flat flexible cable, and a second position in which said opening is narrowed such that said an edge of a backing plate of said inserted flat flexible cable is firmly biased by said elongate latch of said supporting platform.

2. The FFC connector as recited in claim 1, wherein said interlocking means includes cam surfaces located on opposite ends of said supporting platform, and clips formed on said cover for engaging with said cam surfaces of said supporting platform.

3. The FFC connector as recited in claim 2, wherein each said cam surface includes a recess for position of said clip.

4. The arrangement as recited in claim 2, wherein a front edge of said back plate of the FFC is mechanically engaged with said terminals.

5. The FFC connector as recited in claim 4, wherein said cam is securely positioned within said recess of said cam surface at said second position.

6. An arrangement for locking an FFC to an FFC connector, comprising:

a housing of the connector defining a slot for receiving said FFC therein;

a plurality of terminals disposed in the housing and in communication with said slot;

a supporting platform and a cover commonly defining therebetween a slit for receiving both a plurality of juxtaposed conductors and an associated back plate of the FFC therein, and a relatively smaller opening for only allowing said conductors of said FFC to extend outward therethrough, wherein a rear edge of said back plate of the FFC abuts against a latch formed on one of said platform and said cover; and interlocking means arranged between said supporting platform and said cover for attaching said cover to said supporting platform in two-step, wherein said cover can be arranged in a first position in which an opening is defined for insertion of said flat flexible cable, and a second position in which said opening is narrowed such that said an edge of a backing plate of said inserted flat flexible cable is firmly biased by said elongate latch of said supporting platform.

7. The arrangement as recited in claim 6, wherein a front edge of said back plate of the FFC is mechanically engaged with said terminals.

* * * * *